US009528722B1

(12) United States Patent
Hansen et al.

(10) Patent No.: US 9,528,722 B1
(45) Date of Patent: Dec. 27, 2016

(54) VERSATILE ENCAPSULATED FLUID HEATER CONFIGURATION

(71) Applicants: Eric Hansen, Centerville, SD (US); John W. Finger, Beresford, SD (US); Brad Hyronimus, Beresford, SD (US)

(72) Inventors: Eric Hansen, Centerville, SD (US); John W. Finger, Beresford, SD (US); Brad Hyronimus, Beresford, SD (US)

(73) Assignee: Sioux Corporation, Beresford, SD (US)

( * ) Notice: Subject to any disclaimer, the term of this patent is extended or adjusted under 35 U.S.C. 154(b) by 383 days.

(21) Appl. No.: 14/333,119

(22) Filed: Jul. 16, 2014

(51) Int. Cl.

| | |
|---|---|
| ***F24H 1/10*** | (2006.01) |
| ***H05B 3/04*** | (2006.01) |
| ***H05B 3/06*** | (2006.01) |
| ***H05B 3/44*** | (2006.01) |
| ***H05B 3/78*** | (2006.01) |
| ***F24H 9/02*** | (2006.01) |

(52) U.S. Cl.
CPC ..... *F24H 9/02* (2013.01); *F24H 1/102* (2013.01); *H05B 3/78* (2013.01); *H05B 3/04* (2013.01); *H05B 3/06* (2013.01)

(58) Field of Classification Search
None
See application file for complete search history.

(56) References Cited

U.S. PATENT DOCUMENTS

| | | | | |
|---|---|---|---|---|
| 2,589,566 | A | 3/1952 | Neth | |
| 2,640,138 | A | 5/1953 | Merritt | |
| 2,813,964 | A | 11/1957 | Cerulli | |
| 2,866,884 | A | 12/1958 | Minier | |
| 3,134,889 | A | 5/1964 | Drugmand | |
| 3,286,079 | A | 11/1966 | Hynes | |
| 3,446,937 | A | 5/1969 | Hugentobler | |
| 3,610,330 | A | 10/1971 | Nasser | |
| 3,638,619 | A | 2/1972 | Hall | |
| 3,721,291 | A | 3/1973 | Massaro, Jr. | |
| 3,768,132 | A | 10/1973 | Garber | |
| 3,831,673 | A | 8/1974 | Hayden | |
| 3,860,787 | A | 1/1975 | Strobach | |
| 3,992,608 | A | 11/1976 | Snavely | |
| 4,185,187 | A * | 1/1980 | Rogers | F24H 9/2014 219/496 |
| 4,286,139 | A | 8/1981 | Taylor | |
| 4,345,549 | A | 8/1982 | Colmano | |
| 4,364,161 | A | 12/1982 | Stading | |
| 4,395,618 | A | 7/1983 | Cunningham | |
| 4,436,983 | A | 3/1984 | Solobay | |
| 4,465,039 | A | 8/1984 | Snelgrove | |
| 4,514,617 | A | 4/1985 | Amit | |

(Continued)

*Primary Examiner* — Joseph M Pelham
(74) *Attorney, Agent, or Firm* — Jeffrey A. Proehl; Woods, Fuller, Shultz & Smith, P.C.

(57) ABSTRACT

A fluid heater for heating fluid at high pressure may comprise a containment vessel with a base portion having a primary face with a peripheral surface section having a substantially frusta-conical shape. The vessel may comprise an elongated main portion having a perimeter wall with a thickness and terminating with a base edge surface. The base edge surface may have a substantially frusta-conical shape such that the base edge surface and the peripheral surface section collectively form a weld receiving groove. A width of the peripheral surface section of the primary face of the base portion may be greater than the thickness of the perimeter wall of the main portion.

12 Claims, 6 Drawing Sheets

(56) References Cited

U.S. PATENT DOCUMENTS

| | | | |
|---|---|---|---|
| 4,552,162 | A | 11/1985 | Finger |
| 4,567,350 | A | 1/1986 | Todd Jr. |
| 5,058,197 | A | 10/1991 | Honkomp |
| 5,159,659 | A | 10/1992 | Cameron |
| 5,292,056 | A | 3/1994 | Borchert |
| 5,305,419 | A | 4/1994 | Cameron |
| 5,408,578 | A | 4/1995 | Bolivar |
| 6,289,177 | B1 | 9/2001 | Finger |

* cited by examiner

VERSATILE ENCAPSULATED FLUID HEATER CONFIGURATION

BACKGROUND

Field

The present disclosure relates to electric fluid heaters and more particularly pertains to a new versatile encapsulated fluid heater configuration for producing encapsulation vessels with different operating capabilities with fewer unique parts.

Description of the Prior Art

Fluid heating apparatus that employ an encapsulated electrical heating element are highly useful for environments where utilizing a flame or combustion to heat the fluid is not suitable. In these types of heating apparatus, the electrical heating element is typically encapsulated or enclosed in a chamber formed by a containment vessel. The fluid passing out of the chamber is directed to the desired end use for the fluid, such as a spray gun, and fluid entering the chamber has already passed through a pump and been brought up to the pressure desired at the outlet of the apparatus. The range of pressures at which the fluid passes through the chamber may range up to 3,000 psi or more. Illustrative embodiments of encapsulated fluid heaters are disclosed in U.S. Pat. No. 6,289,177 which is assigned to the same assignee as the present application and which is hereby incorporated by reference in its entirety.

As shown in FIG. 6, prior encapsulation vessels 1 have generally included a main portion 2 which is generally tubular with a closed end, and a base portion 3 which is welded to the open end of the main portion opposite of the closed end and supports the heating elements in the chamber. A pedestal 4 of the base portion is inserted into the open end and forms a shoulder 5 for sliding the perimeter wall 6 of the main portion over prior to joining the main portion to the base portion by welding.

Due to the wide range of pressures that may be utilized in such fluid heating apparatus, the strength of the encapsulating structure must be matched to the pressures being utilized in a particular apparatus in order to avoid leakage or an explosive failure. The vessel walls are generally thicker in those apparatus that utilize higher fluid pressures and the vessel walls are relatively thinner in apparatus utilizing relatively lower fluid pressures. The walls of the vessel are constructed with a thickness that is necessary for the pressures to be generated, but are usually not thicker than the necessary wall thickness in order to minimize the weight of the vessel (and thus the overall weight of the apparatus) and minimize the expense of the materials. Typically the containment vessels use tubular structures that have about the same outer diameter to maintain compatibility of the vessels of different operating pressures with other elements of the fluid heating apparatus without significant alterations to the overall design, and the variation in wall thickness is accomplished by varying the inner diameter of the tubular structure to provide the necessary wall thickness for the specific pressure range to be used in a particular heater apparatus.

SUMMARY

In one aspect, the disclosure relates to an electrically powered fluid heater for heating fluid at high pressure, which may comprise a containment vessel for defining a chamber, and the containment vessel may comprise a base portion having a primary face with a central surface section and a peripheral surface section extending about the central surface section. The peripheral surface section may have a substantially frusta-conical shape. The vessel may also comprise an elongated main portion with a closed outward end and an open base end for mounting to the base portion, and the main portion may have a substantially cylindrical perimeter wall extending from the base end toward the outward end. The perimeter wall may have a thickness and terminating at the base end of the main portion with a base edge surface, and the base edge surface may have a substantially frusta-conical shape such that the base edge surface and the peripheral surface section collectively form a weld receiving groove. A width of the peripheral surface section of the primary face of the base portion may be greater than the thickness of the perimeter wall of the main portion. The heater may also include at least one heating element mounted on the base portion and extending into the heating chamber.

In another aspect, the disclosure relates to a system for assembling a containment vessel for an electrically powered fluid heater for heating fluid at high pressure. The vessel may define a chamber. The system may comprise a base portion configured for having at least one heating element mounted thereon to extend into the heating chamber of an assembled vessel. The base portion may have a primary face with a central surface section and a peripheral surface section extending about the central surface section, and the peripheral surface section may have a substantially frusta-conical shape. The system may also comprise a plurality of elongated main portions, with each main portion having a closed outward end and an open base end for mounting to the base portion and each main portion having a substantially cylindrical perimeter wall extending from the base end toward the outward end. The perimeter walls may terminate at the base end with a base edge surface having a substantially frusta-conical shape. The perimeter walls of at least two of the main portions may each have a different thickness and inner diameter. A width of the peripheral surface section of the primary face of the base portion may be greater than the thickness of the perimeter wall of each of the main portions of the plurality such that the peripheral surface section is able to form a weld receiving groove with the base edge surface of the perimeter walls of different thicknesses of the main portions of the plurality.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

With reference now to the drawings, and in particular to FIGS. 1 through 5 thereof, a new versatile encapsulated fluid heater configuration embodying the principles and concepts of the disclosed subject matter will be described.

Figure 6:
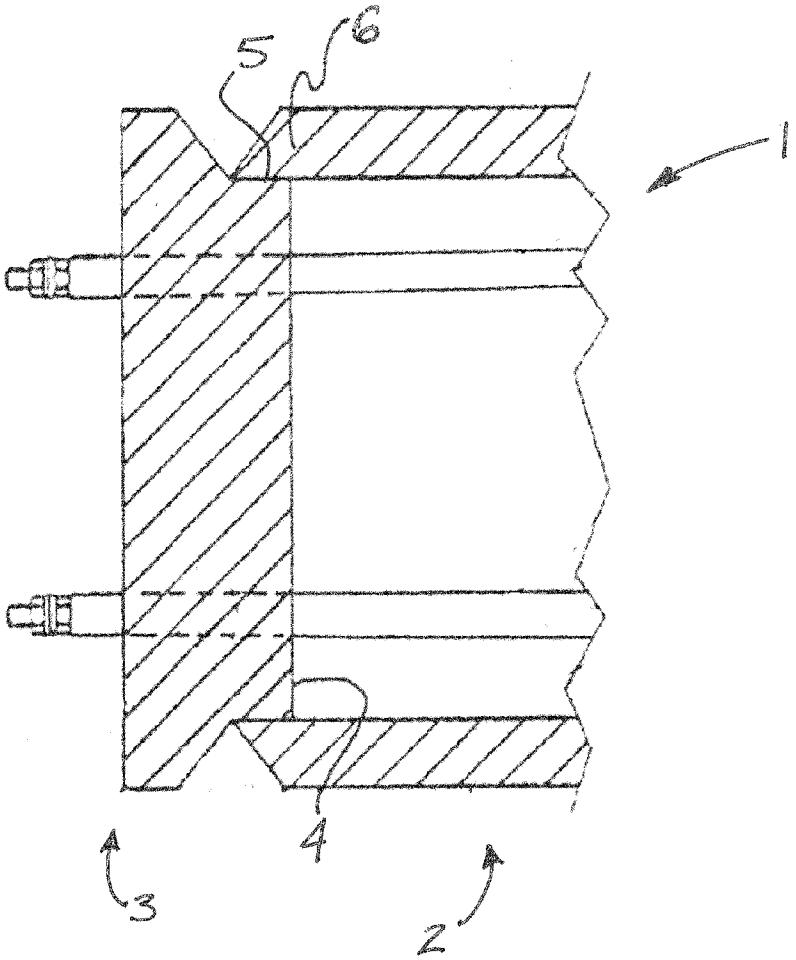
FIG. 6 is a schematic particle section view of a prior art encapsulation structure.

Applicants have recognized that the range of pressures utilized in fluid heating apparatus require a wide range of wall thicknesses in the main portion of the encapsulation vessel and as a result a wide range of configurations for the base portion of the vessel. Significantly, as the thickness of the wall of the main portion is changed, the configuration of the base portion on which the heating elements are mounted has also been varied to accommodate the range of wall thicknesses. While the scaling up or down of the wall thickness of the main portion of the vessel is relatively straightforward in that a pipe and a cap of relatively thicker or thinner wall thickness may be utilized for forming the vessel, applicants have also recognized that the thickness of the walls of the vessel have also required different configurations of some aspects of the base portion in order to accommodate the thicker or thinner walls of the vessel, while many other aspects of the base portion remain substantially the same despite the ticker or thinner walls. Conventionally, a different design has been employed for base portions used for each of the different wall thicknesses. In prior designs (see FIG. 6), the pedestal 4 of the base portion forms a shoulder 5 with a diameter that generally corresponds to the inner diameter of the perimeter wall 6 of the main portion 2, and thus the pedestal has a different diameter size for every different wall thickness of the main portion which requires a base portion of a different configuration.

The applicants have recognized that it would be advantageous be able to use one base portion configuration for more than one vessel wall thickness to reduce the number of different base portion configurations that need to be manufactured and inventoried for producing fluid heaters that operate at a plurality of different internal pressures.

The disclosure relates to a containment vessel 10 which is highly useful for encapsulating the heating elements 52 of an electrically powered fluid heater for heating fluid at relatively high pressures, such as used in pressure washing apparatus, although the manner in which the vessel is formed may find use in vessels for other apparatus.

The containment vessel 10 may define a heating chamber 12 through which fluid may be moved to heat the fluid in a substantially continuous manner. The containment vessel 10 may generally include a base portion 14 and a main portion 16 which are united together in a manner that is unique. Significantly, the dimensions of the base portion may be substantially uniform across pressure vessels designed for different fluid operating pressures.

The base portion 14 of the containment vessel 10 may have a perimeter 18, and a perimeter surface 20 forming the perimeter. The perimeter 18 may have a substantially circular shape and the perimeter surface 20 may be substantially cylindrical, although this is not critical. The base portion 14 may have a primary face 22 with surface sections, and typically there are at least two surface sections. One surface section may include a central surface section 24, which may be substantially planar. Another surface section may comprise a peripheral surface section 26 which may extend about the central surface section 26 and may extend from the central surface section 24 to the perimeter surface 20.

In the illustrative embodiments, the base portion 14 includes a base pedestal 28 for insertion into the main portion, a base plate 30 located adjacent to the base pedestal and which may be integrally formed with the base pedestal, and a base flange 32 that extends generally outward from the base plate 30. The base pedestal 28 may have a pedestal perimeter surface 33 that extends about the pedestal 28 and the central surface section 24, and may be substantially cylindrical in shape.

The main portion 16 may be elongated with a base end 34 and an outward end 36, and may have a perimeter wall 38 extending from the base end toward the outward end. In some embodiments, the main portion 16 may include a body section 40 and a cap section 42, and the cap section may be fused with the body section of the vessel prior to assembly of the vessel. The body section may generally be substantially cylindrical and the cap section may generally be domed in shape.

The perimeter wall 38 of the body section 40 may have a thickness W that is substantially uniform in dimension from the base end 34 toward the outward end 36, and thus the body section may be formed by a section of pipe. The thickness W of the perimeter wall is generally governed by the internal pressure of the chamber that the vessel must withstand with a margin of safety. For example, for one operating pressure, a suitable containment vessel may have a perimeter wall with a first thickness W with a first inner diameter ID, and for a second and different internal pressure, the perimeter wall may have a second thickness W with a second inner diameter ID, with the second thickness being greater or thicker than the first thickness and the first diameter being greater than the second diameter due to the greater wall thickness. Examples of such variations in thickness and diameter are illustrated in FIGS. 2 through 5 of the drawings.

The perimeter wall 38 of the main portion may have a base edge surface 44 at the base end 34, and the thickness of the perimeter wall may be tapered toward the base end such that the base edge surface has a frusta-conical shape. Thus a radially inner extent 46 of the perimeter wall may extend further from the outward end than a radially outer extent 48 of the perimeter wall to form a bevel at a bevel angle. Generally, the portion of the perimeter wall that forms the base edge surface, and is tapered in thickness, is not greater than approximately twice the thickness of the perimeter wall over the majority of the length of the main portion, and in many embodiments the portion that is tapered is approximately equal to the thickness of the majority of the perimeter wall.

One significant aspect of the disclosure is the contouring of the peripheral surface section 26 of the primary face of the base portion and the interrelationship of that contouring with the contouring of the base edge surface 44 of the perimeter wall. The peripheral surface section 26 may have a configuration such that the peripheral surface section 26 and the surface of the end edge surface 44 provide converging surfaces. In many of the most preferred embodiments, the peripheral surface section 26 has a frusta-conical shape, and may have a bevel angle that is similar or substantially the same as the bevel angle of the base edge surface.

Figure 1:
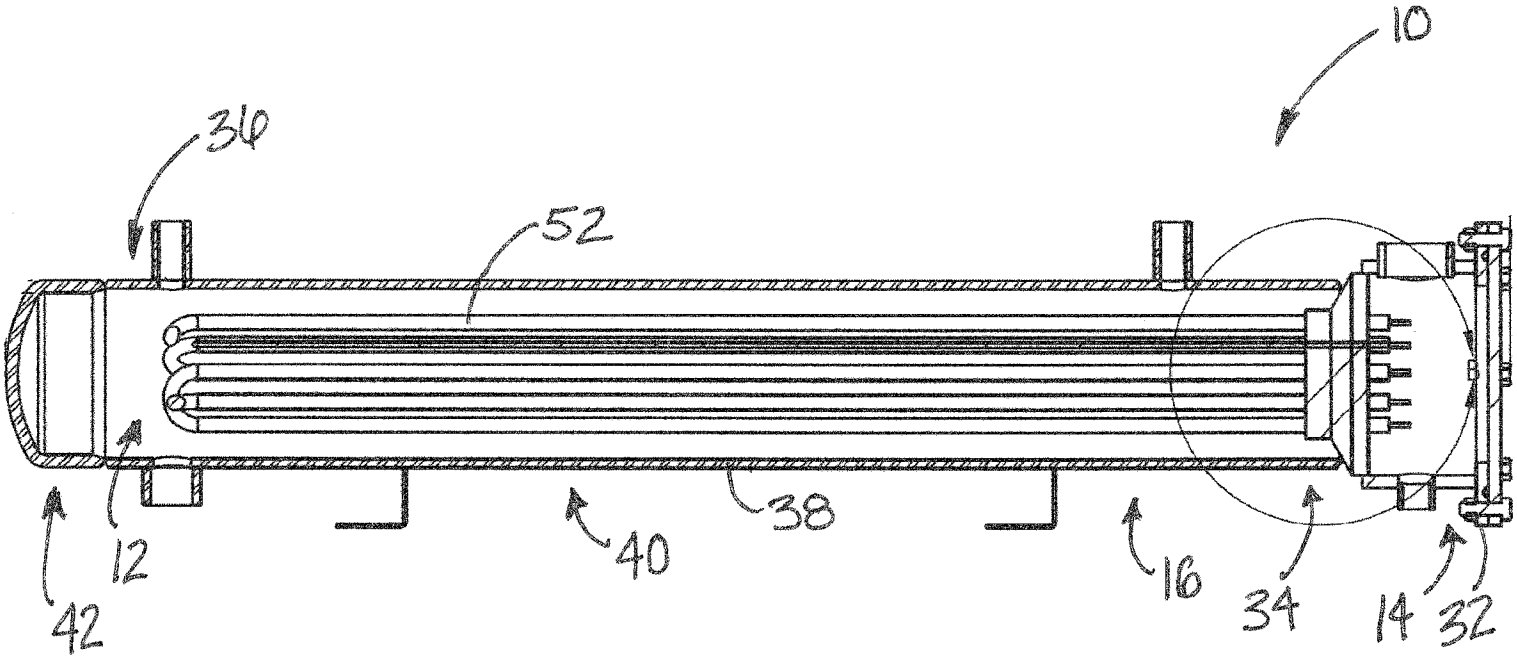
FIG. 1 is a schematic side sectional view of a new versatile encapsulated fluid heater configuration according to the present disclosure.
Figure 2:
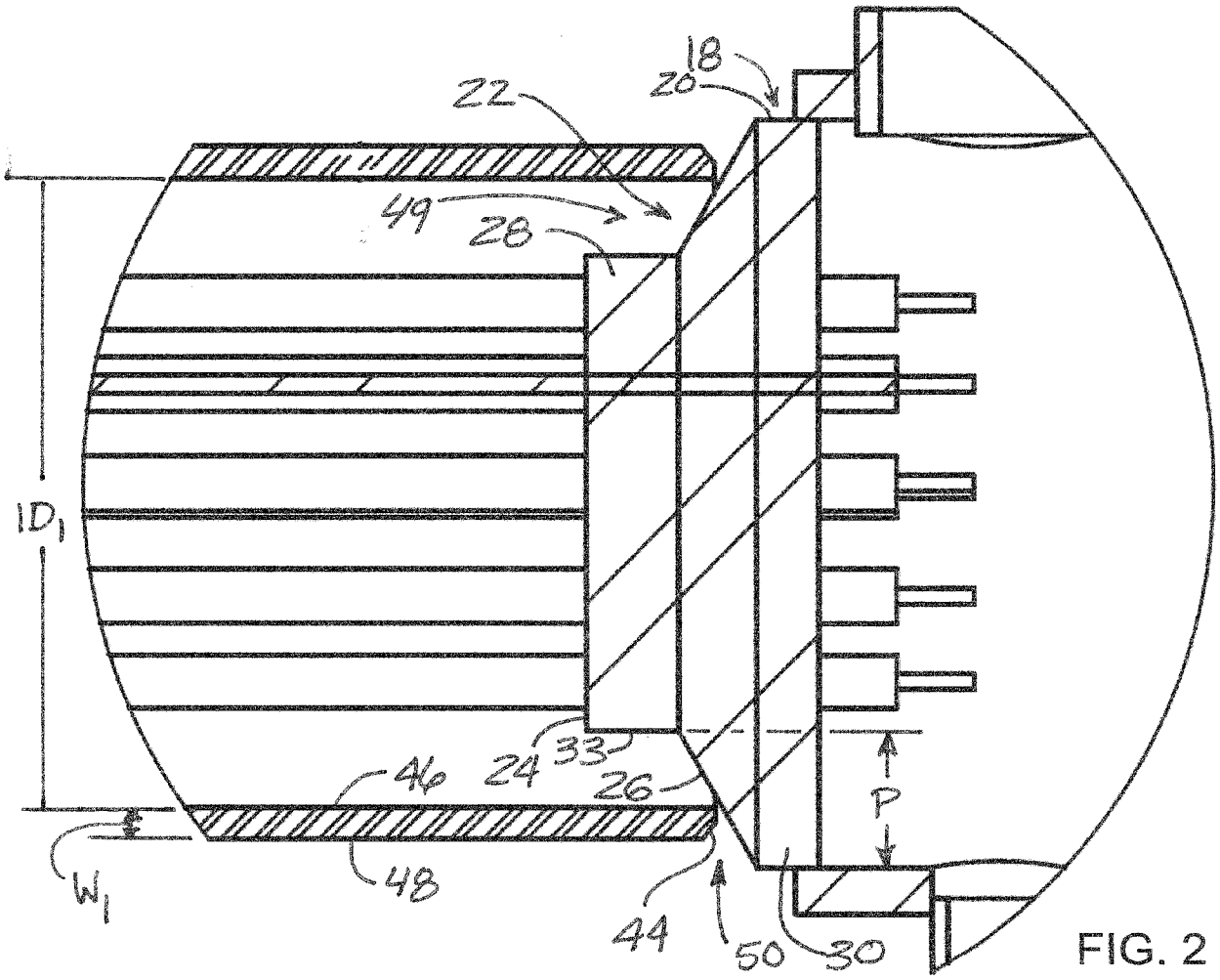
FIG. 2 is a schematic partial side sectional view of an encapsulation vessel according to the present disclosure in which a first wall thickness for the main portion is employed.
Figure 3:
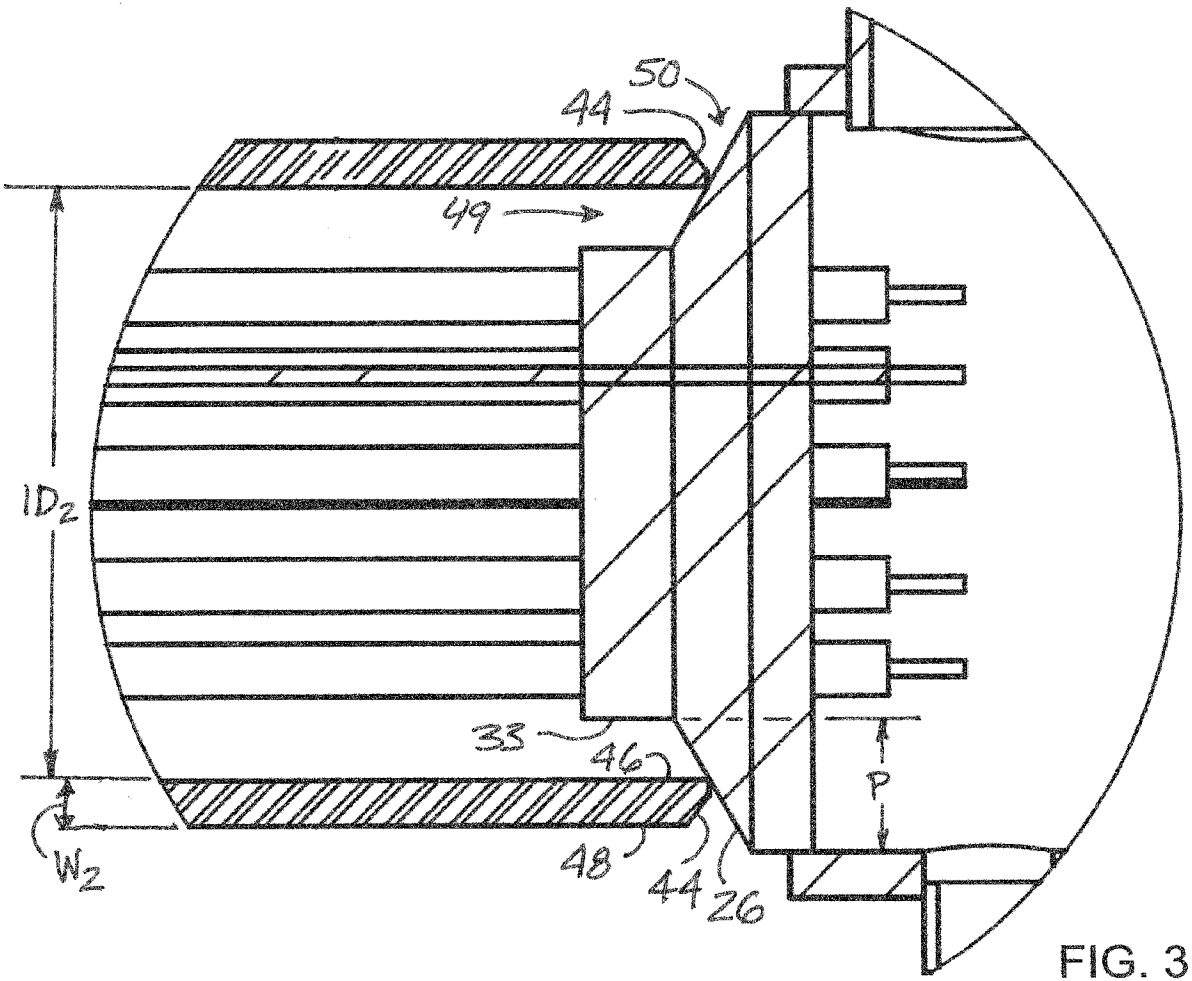
FIG. 3 is a schematic partial sectional view of an encapsulation vessel according to the present disclosure is employed in which a second wall thickness for the main portion is employed that is relatively thicker than the first wall thickness.
Figure 4:
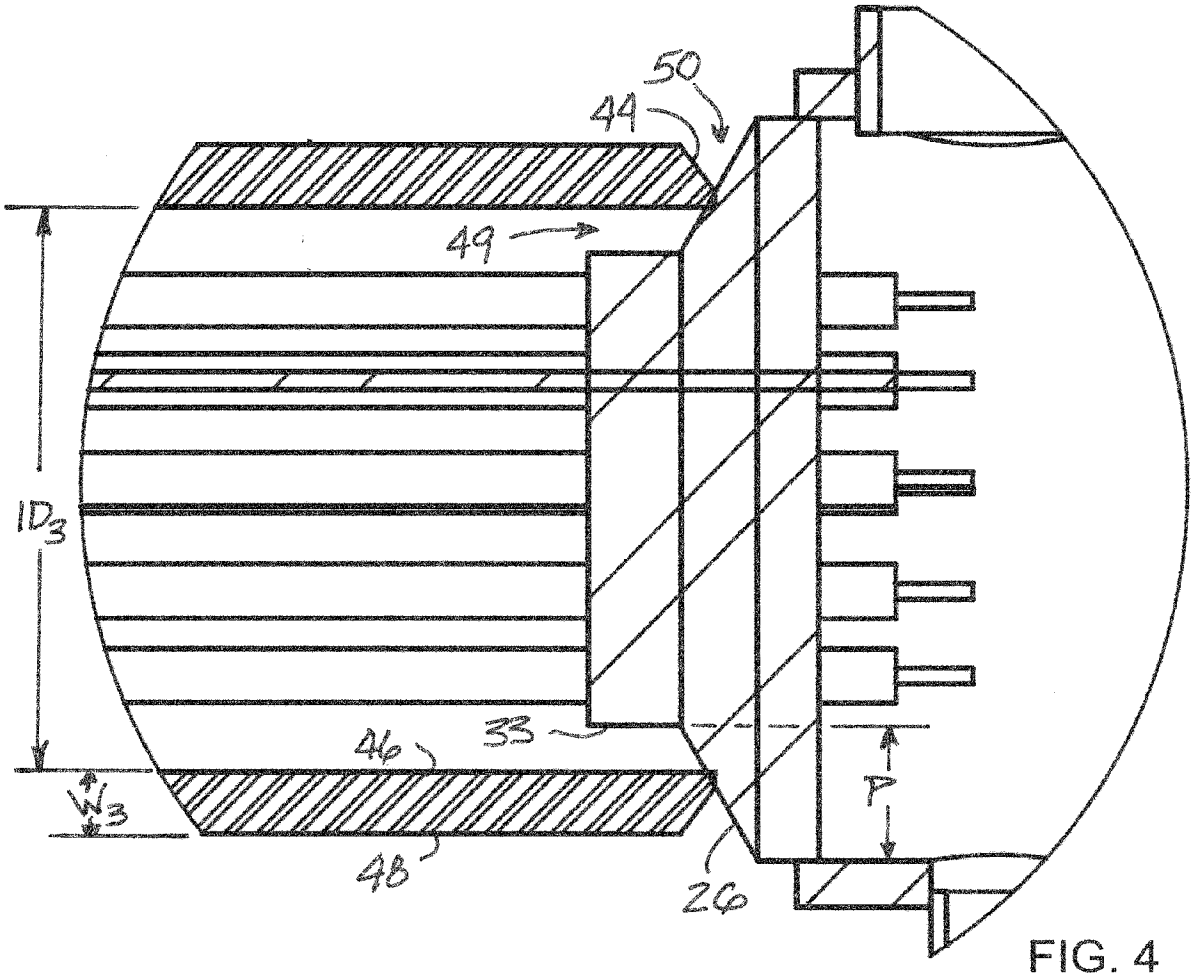
FIG. 4 is a schematic partial sectional view of an encapsulation vessel according to the present disclosure is employed in which a third wall thickness for the main portion is employed that is relatively thicker than the first and second wall thicknesses.
Figure 5:
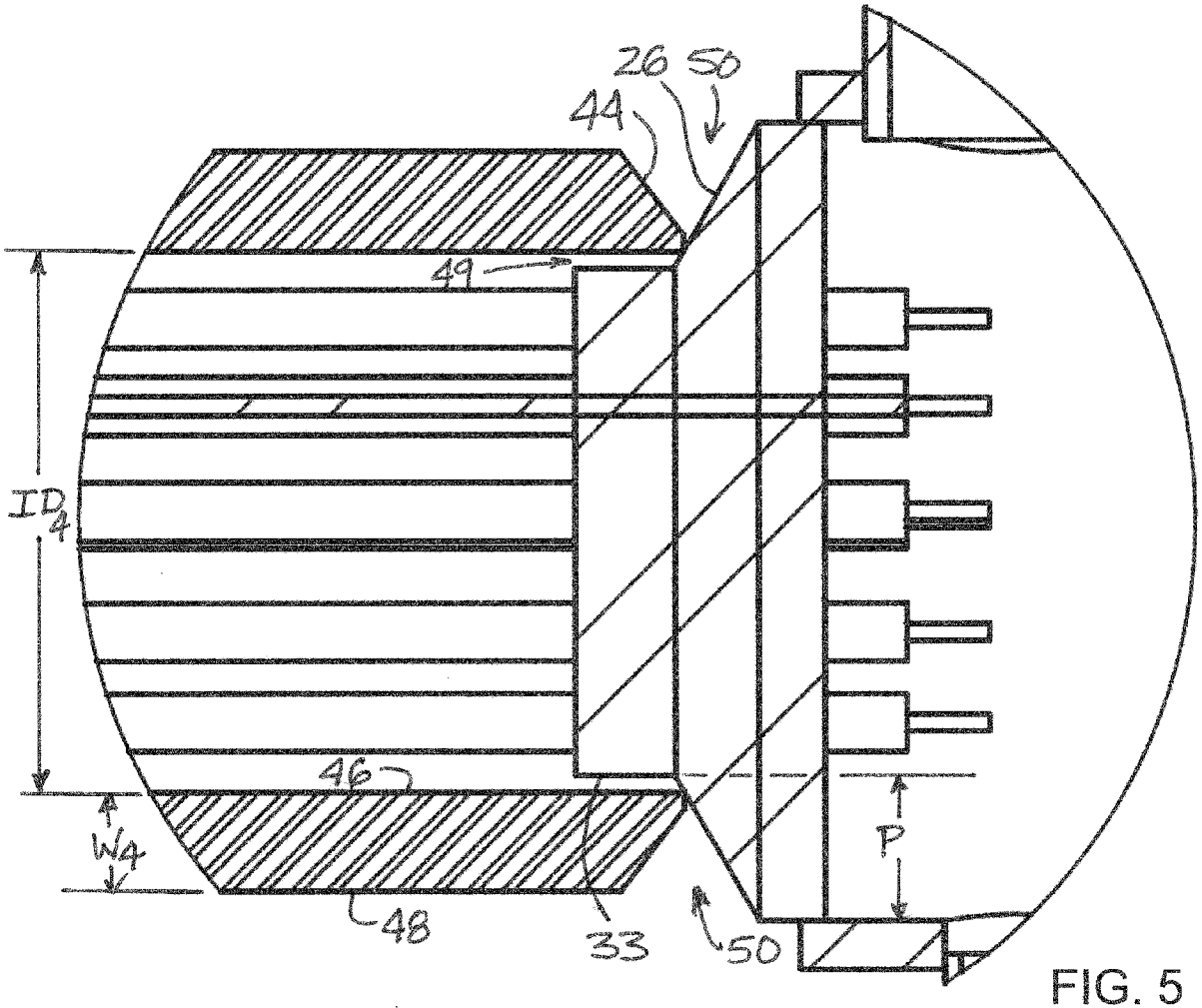
FIG. 5 is a schematic partial sectional view of an encapsulation vessel according to the present disclosure is employed in which a fourth wall thickness for the main portion is employed that is relatively thicker than the first, second and third wall thicknesses.

The peripheral surface section 26 of the primary face 22 may have a width P measured in the same direction as the wall thickness W and the inner diameter ID, and shown in FIGS. 2 through 5. In some of the most preferred embodiments, the width P of the peripheral surface section is greater than the wall thickness W of the thickest perimeter wall of main portions to be used with the base portion having the peripheral surface section 26. In some embodiments, the width P of the peripheral surface section 26 is at least approximately 110 percent of the thickness W of the perimeter wall of the main portion, and in some embodiments the width P of the peripheral surface section is at least approximately 125 percent of the thickness W of the perimeter wall of the main portion. In some further embodiments, the width P of the peripheral surface section is at least approximately 150 percent of the thickness W of the perimeter wall. In some illustrative examples, FIG. 2 shows a width P of the peripheral surface section is approximately 400% of the thickness W of the perimeter wall, FIG. 3 shows a width P that is approximately 300% of the thickness W, FIG. 4 shows a width P that is approximately 200% of the thickness W, and FIG. 5 shows a width P that is approximately 150% of the thickness W. As illustratively examples, wall thicknesses W of 5/16 inch, 9/16 inch, ¾ inch may be employed, but the disclosure is not so limited.

The peripheral surface section 26 may extend from the perimeter surface 20 of the base perimeter 18 to the central surface section 24 of the pedestal, and a diameter of the pedestal may be less than the inner diameter ID of the perimeter wall 38 of the main portion 16, and may be less than the smallest inner diameter (which has the thickest wall thickness) of the main portions to be used with the particular base portion. Thus, for a range of main portions with different wall thicknesses, the pedestal diameter of a base to be used with all main portions of the range of main portions may be less than the diameter of the main portion with the thickest perimeter wall, such that a gap 49 is formed between the inner surface of the wall 38 of the main portion and the pedestal perimeter surface 33 of the base portion. The size of the gap varies as the wall thickness W and corresponding inner diameter ID varies, and the location on the peripheral surface section 26 at which the base edge section contacts the surface section 26 also changes with the change in the wall thickness.

FIGS. 2 through 5 of the drawings illustrate four different main portions (with a range of wall thicknesses) in relation to the same base portion configuration and measurement. More specifically, FIG. 2 depicts a first wall thickness W1 that is designed for relatively lower operation pressures in the chamber, and has a relatively thinner wall thickness that provides a relatively greater inner diameter ID1, and as a result the size of the gap 49 is relatively large in this configuration. In FIG. 3 is illustrated a main portion that is designed for operating at relatively higher chamber pressures as compared to the main portion depicted in FIG. 2, and has a second wall thickness W2 that is relatively thicker than the wall thickness W1 of the main portion in FIG. 2, and an inner diameter ID2 that is relatively smaller than the inner diameter ID1. The gap 49 shown in FIG. 3 is thus somewhat smaller than the gap in FIG. 2. FIG. 4 shows a main portion with a still thicker wall thickness W3 for operating at greater chamber pressures than the main portions of FIGS. 2 and 3, and has a smaller inner diameter ID3 and a smaller gap 39 than for the embodiments shown in FIGS. 2 and 3. FIG. 4 depicts an embodiment for operating at the relatively highest chamber operating pressures, and has the thickest wall thickness W4, with the smallest inner diameter ID4 and gap size, of the four embodiments shown in FIGS. 2 through 5.

The bevel of the peripheral surface section 26 of the primary face of the base portion and the bevel of the base edge surface 44 of the perimeter wall of the main portions may form a weld groove 50 for perimeter walls having at least two different inner diameters. Significantly, the configuration of the weld groove rains relatively consistent and uniform between the different perimeter wall thicknesses, such as those illustrated in FIGS. 2 through 5, even though the relative position of the weld may by shifted along the peripheral surface section 26 of the primary face 22 of the base portion. The weld groove formed by the surfaces 26, 44 may be highly suitable for receiving a fillet weld to join the base portion to the main portion. The weld groove may have a substantially V-shape.

Thus, a similar weld groove may be formed irregardless of a specific inner diameter of the perimeter wall or the thickness of the perimeter wall of the main portion, within a given range of inner diameters, which allows the same base portion size configuration to be used with main portions having a range of different inner diameters. The A heating element 52 may extend into the heating chamber 12, and the heating element may be mounted on the base portion 14 and may be cantilevered from the base portion into the main portion 16. The heating element 52 may extend from the base portion 14 into the heat chamber toward the outward end of the main portion. In some illustrative embodiments, the heating element may be substantially U-shaped.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. An electrically powered fluid heater for heating fluid at high pressure, comprising:

a containment vessel for defining a chamber, the containment vessel comprising:

a base portion having a primary face with a central surface section and a peripheral surface section extending about the central surface section, the peripheral surface section having a substantially frusto-conical shape; and an elongated main portion with a closed outward end and an open base end for mounting to the base portion, the main portion having a substantially cylindrical perimeter wall extending from the base end toward the outward end, the perimeter wall having a thickness and terminating at the base end of the main portion with a base edge surface, the base edge surface having a substantially frusto-conical shape such that the base edge surface and the peripheral surface section collectively form a weld receiving groove;

wherein a width of the peripheral surface section of the primary face of the base portion is greater than the thickness of the perimeter wall of the main portion; and at least one heating element mounted on the base portion and extending into the heating chamber.

2. The heater of claim 1 wherein the width of the peripheral surface section of the primary face of the base portion is at least approximately 110 percent of the thickness of the perimeter wall of the main portion.

3. The heater of claim 1 wherein the width of the peripheral surface section of the primary face of the base portion is at least approximately 125 percent of the thickness of the perimeter wall of the main portion.

4. The heater of claim 1 wherein the width of the peripheral surface section of the primary face of the base portion is at least approximately 150 percent of the thickness of the perimeter wall of the main portion.

5. The heater of claim 1 wherein the base portion includes a base pedestal with the central surface section of the primary face of the base portion thereon and a substantially cylindrical pedestal perimeter surface surrounding the central surface section, the pedestal perimeter surface and an inner surface of the perimeter wall of the main portion defining a gap therebetween.

6. The heater of claim 5 wherein the gap is relatively greater when the perimeter wall of the main portion is relatively thinner and the gap is relatively lesser when the perimeter wall of the main portion is relatively thicker.

7. The heater of claim 1 wherein the weld-receiving groove has a substantially V-shaped configuration.

8. A system for assembling a containment vessel for an electrically powered fluid heater for heating fluid at high pressure, the vessel defining a chamber, the system comprising:

a base portion configured for having at least one heating element mounted thereon to extend into the heating chamber of an assembled vessel, the base portion having a primary face with a central surface section and a peripheral surface section extending about the central surface section, the peripheral surface section having a substantially frusto-conical shape; and a plurality of elongated main portions, each main portion having a closed outward end and an open base end for mounting to the base portion, each main portion having a substantially cylindrical perimeter wall extending from the base end toward the outward end, the perimeter wall terminating at the base end with a base edge surface having a substantially frusto-conical shape, wherein the perimeter walls of at least two of the main portions each have a different thickness and inner diameter; and wherein a width of the peripheral surface section of the primary face of the base portion is greater than the thickness of the perimeter wall of each of the main portions of the plurality such that the peripheral surface section is able to form a weld receiving groove with the base edge surface of the perimeter walls of different thicknesses of the main portions of the plurality.

9. The system of claim 8 wherein the width of the peripheral surface section of the primary face of the base portion is at least approximately 110 percent of the thickness of the perimeter wall of each of the main portions.

10. The system of claim 8 wherein the width of the peripheral surface section of the primary face of the base portion is at least approximately 150 percent of the thickness of the perimeter wall of each of the main portion.

11. The system of claim 8 wherein the base portion includes a base pedestal with the central surface section of the primary face of the base portion thereon and a substantially cylindrical pedestal perimeter surface surrounding the central surface section, the pedestal perimeter surface and an inner surface of the perimeter wall of each of the main portions being configured to define a gap therebetween.

12. The system of claim 11 wherein the gap is relatively greater for a said main portion in which the perimeter wall is relatively thinner and the gap is relatively lesser for a said main portion in which the perimeter wall is relatively thicker.

* * * * *